US010217538B2

(12) United States Patent
Labaune et al.

(10) Patent No.: US 10,217,538 B2
(45) Date of Patent: Feb. 26, 2019

(54) CREATION OF ISOTOPES USING LASER BEAMS

(71) Applicant: ECOLE POLYTECHNIQUE, Palaiseau (FR)

(72) Inventors: Christine Labaune, Palaiseau (FR); Johann Rafelski, Tuscon, AZ (US)

(73) Assignee: ECOLE POLYTECHNIQUE, Palaiseau (FR)

( * ) Notice: Subject to any disclaimer, the term of this patent is extended or adjusted under 35 U.S.C. 154(b) by 443 days.

(21) Appl. No.: 14/906,951

(22) PCT Filed: Jul. 15, 2014

(86) PCT No.: PCT/FR2014/051819
§ 371 (c)(1),
(2) Date: Jan. 22, 2016

(87) PCT Pub. No.: WO2015/011370
PCT Pub. Date: Jan. 29, 2015

(65) Prior Publication Data

US 2016/0172065 A1 Jun. 16, 2016

(30) Foreign Application Priority Data

Jul. 22, 2013 (FR) ..... 13 57192

(51) Int. Cl.
*G21G 1/10* (2006.01)
*G21G 1/06* (2006.01)
(Continued)

(52) U.S. Cl.
CPC ..... *G21G 1/10* (2013.01); *G21G 1/06* (2013.01); *G21G 1/12* (2013.01); *H05H 1/0043* (2013.01)

(58) Field of Classification Search
CPC .... G21G 1/10; G21G 1/12; G21G 2001/0015; G21K 5/08
See application file for complete search history.

(56) References Cited

U.S. PATENT DOCUMENTS 3,778,585 A * 12/1973 Mallozzi ..... G21B 1/23 219/121.74
4,504,964 A * 3/1985 Cartz ..... B82Y 10/00 378/119

(Continued)

FOREIGN PATENT DOCUMENTS

EP 1 453 063 A1 9/2004

OTHER PUBLICATIONS

Badziak, J., "Laser-driven generation of fast particles," Opto-Electronics Review, vol. 15, No. 1, 2007, pp. 1-12.

(Continued)

*Primary Examiner* — Sharon M Davis
(74) *Attorney, Agent, or Firm* — Oliff PLC

(57) ABSTRACT

A method for creating isotopes using laser beams, including the steps: 1) placing a target under plasma conditions, 2) bombarding the target under plasma conditions with particles generated using a bundle of laser beams, the bundle of laser beams being synchronized with the development of the plasma conditions, the fuel and the particles being selected in such a way that the interaction between the target under plasma conditions and the particles generates nuclear reactions, and 3) recovering the isotopes generated by the nuclear reactions.

8 Claims, 2 Drawing Sheets

(51) Int. Cl.
*H05H 1/00* (2006.01)
*G21G 1/12* (2006.01)

(56) References Cited

U.S. PATENT DOCUMENTS

| | | | | |
|---|---|---|---|---|
| 4,704,718 | A * | 11/1987 | Suckewer | H01S 4/00 372/37 |
| 6,909,764 | B2 | 6/2005 | Maksimchuk et al. | |
| 2002/0141537 | A1* | 10/2002 | Mochizuki | G21B 1/23 378/119 |
| 2002/0172317 | A1* | 11/2002 | Maksimchuk | G21G 1/10 376/190 |
| 2008/0023645 | A1* | 1/2008 | Amelia | G21G 1/00 250/432 R |
| 2012/0307950 | A1* | 12/2012 | Sekine | G21B 1/19 376/103 |

OTHER PUBLICATIONS

Sep. 9, 2014 International Search Report issued in International Patent Application No. PCT/FR2014/051819.

* cited by examiner

CREATION OF ISOTOPES USING LASER BEAMS

The present invention relates to a process and a system for creating isotopes using laser beams in a plasma medium.

A "plasma" re tiers to a partially or completely ionized medium, composed of ions and electrons, with no presupposition regarding temperature and/or equilibrium.

The isotopes created may be stable isotopes or unstable isotopes, which are then referred to as radioisotopes, in their fundamental energy state or excited energy state, which are then referred to as nuclear isomers. In the remainder of the text, they will be grouped together under the term "isotopes".

Isotopes are in particular used in medicine, in the context of diagnostics and therapies. They may also be used for other scientific or industrial applications, for example for tracing products.

Currently the isotopes are generally produced by circular particle accelerators (cyclotrons) or linear particle accelerators, or in nuclear reactors.

However, due to the cost and size of these facilities, production must be carried out at a dedicated site, far from the places of use. This involves organizing rapid and secure transport between the places of manufacture and of use. This also prevents the use of a certain number of isotopes, the lifetimes of which are too short to go through this process, but which would exhibit advantages from the point of view of the applications.

Document U.S. Pat. No. 6,909,764 describes a process for creating isotopes, in which a target is bombarded by particles generated using a laser beam. Isotopes are created by nuclear reactions produced by the interaction between the target and the particles.

The use of a laser beam makes it possible to reduce the size and the cost of the system for creating isotopes. It is thus possible to install the system for creating isotopes in the vicinity of their place of use, eliminating the problem of transport, which is particularly advantageous for isotopes with a short lifetime.

The implementation of the process described in document U.S. Pat. No. 6,909,764 made it possible to measure an activity of $2\times10^5$ Bq with the Vulcan laser facility (Rutherford Laboratory, UK) for the production of carbon-11 ($^{11}C$) with a laser of $10^{20}$ W/cm$^2$, a pulse duration of 750 femtoseconds, a single laser beam and a single pulse during the interaction of the beam of protons with a solid nitrogen-14 ($^{14}N$) target.

However, positron emission tomography (PET) imaging requires an activity of around $5\times10^8$ Bq. The process described in document U.S. Pat. No. 6,909,764 does not therefore make it possible to obtain, with the current lasers, sufficient isotope production level.

There is therefore a need for smaller and less expensive systems for creating isotopes, that may be installed in the vicinity of the place of use of the isotopes, and that make it possible to obtain a sufficient production level. The present invention improves the situation.

For this purpose, the invention proposes a process for creating isotopes using laser beams, comprising steps of:

/1/ converting a target to the plasma state,

/2/ bombarding the target in the plasma state with particles generated using a set of laser beams, the set of laser beams being synchronized with the conversion to the plasma state, the fuel and the particles being selected so that the interaction between the target in the plasma state and the particles produces nuclear reactions, /3/ recovering isotopes generated by the nuclear reactions.

Step /2/ may be repeated once or several times on the same target.

A characteristic duration of the pulses produced by the set of laser beams is, for example, between 50 femtoseconds and 300 picoseconds.

Step /2/ may comprise an operation for production of particles by irradiation of a second solid, structured solid, gaseous or liquid target by the set of laser beams.

According to one embodiment of the invention, the set of laser beams used to bombard the target is a first set of laser beams, the target being converted to the plasma state by using a second set of laser beams synchronised with the first.

A characteristic duration of the pulses produced by the second set of laser beams for example, between one picosecond and twenty nanoseconds.

According to another embodiment of the invention, the target is converted to the plasma state by using a Z-pinch machine.

According to one embodiment of the invention, the target comprises a hollow, the particles bombarding the target inside the hollow.

According to another embodiment of the invention, the target is positioned in an envelope comprising an opening, the particles bombarding the target through the opening.

The fuel and the particles may be selected so that the interaction between the target in the plasma state and the particles produces nuclear chain reactions.

The invention also proposes a computer program comprising instructions for the implementation of the process when this program is executed by a processor.

The invention also proposes system for creating isotopes using laser beams, comprising:

/1/ ionization means configured in order to convert a target to the plasma state, /2/ a set of laser beams configured in order to irradiate the target in the plasma state with particles, the set of laser beams being synchronized with the ionization means, the fuel and the particles being selected so that the irradiation of the target in the plasma state with the particles produces nuclear reactions, /3/ isotope recovery means configured in order to recover isotopes generated by the nuclear reactions.

Other features and advantages of the invention will also appear on reading the following description. This description. is purely illustrative and should be read in connection with the appended drawings, in which:

FIG. 1 represents a system for creating isotopes using laser beams. The isotopes may be stable isotopes, radioisotopes, or nuclear isomers.

Figure 1:
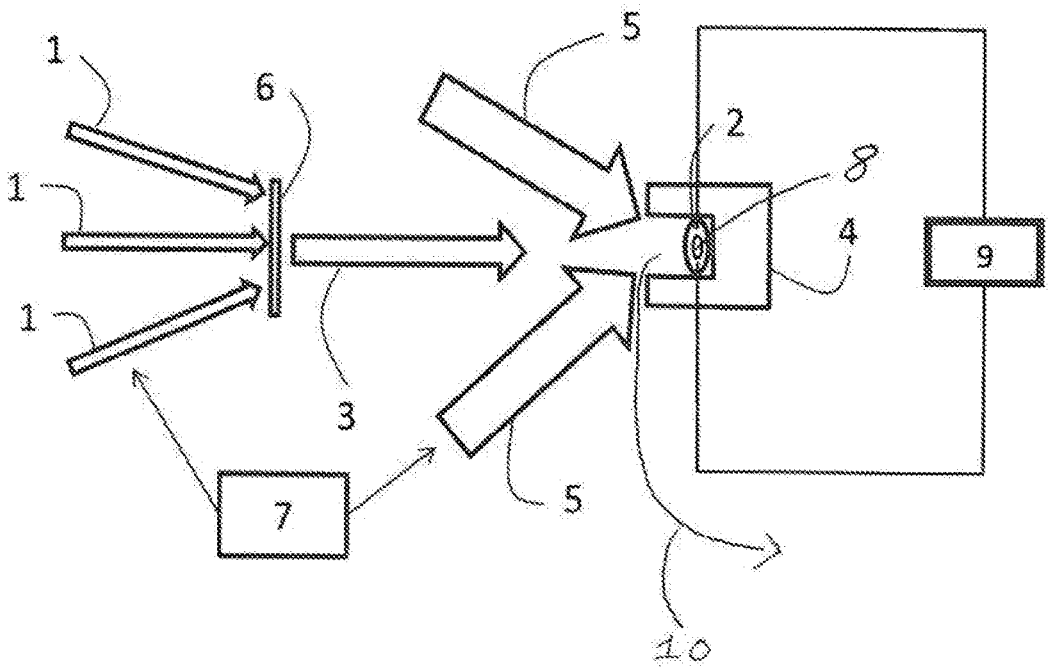
FIG. 1 is a functional diagram showing a system for creating isotopes according to one embodiment of invention.

The system comprises a first set of laser beams 1 configured in order to allow the irradiation of a target 2 in the plasma state with a beam of particles 3.

The target 2 may have various shapes. According to the embodiment of the invention represented in FIG. 1, the target 2 is positioned in an envelope 4 comprising an opening.

According to another embodiment of the invention, the target 2 comprises a hollow 8.

The particles comprise ions and electrons.

The first set of laser beams 1 may comprise one or more laser beam(s). In FIG. 1, three beams have been represented.

A characteristic duration of the pulses produced by the laser beams 1 is, for example, between 50 femtoseconds and 300 picoseconds. The intensity, the wavelength, the duration and the shape of the pulses produced by the laser beams 1 are in addition determined so that the bombardment particles have an energy which is close to, or greater than, that of the resonances of the effective cross section of the nuclear reaction in question. A higher energy makes it possible to take into account the energy losses linked to passing through the plasma surrounding the target 2. The intensity of the laser beams 1 is for example of the order of, or greater than, $10^{18}$ W/cm$^2$.

The system also comprises ionization means 5, configured in order to place the target 2 in the plasma state.

According to the embodiment of the invention represented in FIG. 1, the ionization means comprise a second set of laser beams 5.

The second set of laser beams 5 may comprise one or more laser beam(s). In FIG. 1, two laser beams have been represented.

The pulses that are produced by the second set of laser beams 5 have a characteristic duration of between one picosecond and twenty nanoseconds. The intensity of the laser beams 5 is for example of the order of $10^{12}$-$10^{15}$ W/cm$^2$.

According to another embodiment of the invention, the ionization means 5 comprise an axial necking (Z-pinch) machine 9.

The system also comprises synchronizing means 7, configured in order to synchronize the first set of laser beams and the ionization means 5. Thus, the production of the particles is synchronized with the production of the plasma, so that the target 2 is irradiated while it is in the plasma state.

The system also comprises isotope recovery means 10 configured in order to recover isotopes generated by nuclear reactions.

Figure 2:
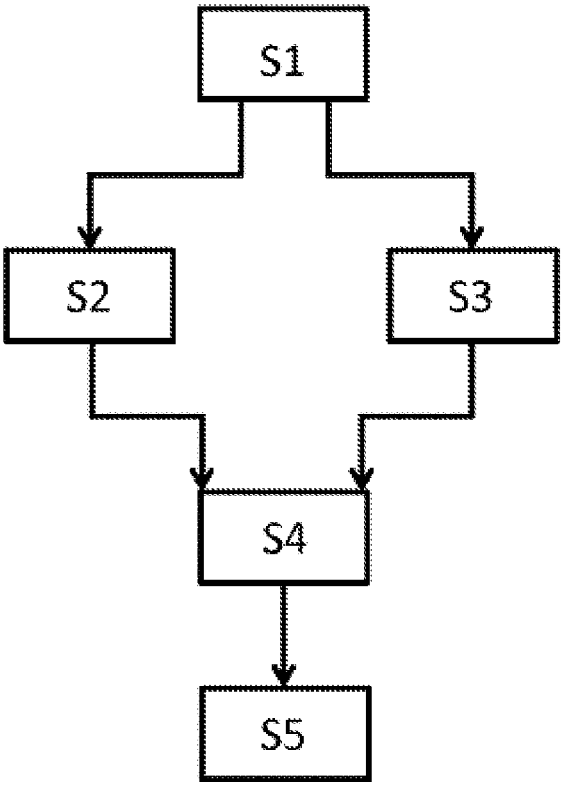
FIG. 2 is a flowchart illustrating the steps of a process for creating isotopes using laser beams according to one embodiment of the invention.

Described below, with reference to FIG. 2, are the steps of a process for creating isotopes using laser beams according to one embodiment of the invention. The process may be implemented by the system described above. The process comprises:

a step S1 of initializing the synchronization, a step S2 of converting a target 2 to the plasma state, a step S3 of generating a beam of particles 3, a step S4 of bombarding the target 2 with the particles 3, and a step S5 of recovering isotopes.

In step S1, the synchronization means 7 are actuated, so as to control the times for carrying out the steps S2 to S4.

Indeed, the creation of the plasma and its bombardment by the particles 3 must be synchronized. In the embodiment of the invention represented, this may be carried out by the synchronization of the first and second sets of laser beams 1, 5.

In step S2, the target 2 is converted to the plasma state. The target 2 may be solid, structured solid, gaseous or liquid.

In step S3, the particles 3 are generated by irradiation of a second target 6 by the first set of laser beams 1. The initial state of the target 6 may be solid, structured solid, gaseous or liquid. The target 6 is for example a metal sheet of limited thickness.

In step S4, the target 2 in the plasma state is bombarded by the particles 3.

The fuel and the particles are selected so that the interaction between the target 2 in the plasma state and the beam of particles 3 produces nuclear reactions.

According to embodiments of the invention, the fuel and the particles are selected so that the interaction between the target 2 in the plasma state and the beam of particles 3 produces nuclear chain reactions. The production of nuclear chain reactions makes it possible to increase the production of isotopes.

Moreover, due to the use of a target 2 in the plasma state, the electrons of the beam of particles 3 interact with the target 2, at the same time as the interaction between the ions of the beam of particles 3 and the target 2. This double interaction also makes it possible to increase the production of isotopes.

When the target 2 comprises a hollow 8, the particles 3 bombard the target 2 inside the hollow 8.

When the target 2 is positioned in an envelope 4 comprising an opening, the particles 3 bombard the target 2 through the opening.

The use of a hollow 8 or of an envelope makes it possible to confine the isotopes produced inside the target 2 or the envelope 4.

Step S4 may be repeated once or several times on the same target 2. The accumulation of laser strikes on the same target 2 makes it possible to increase the production of isotopes. The repetition rate is, for example, of the order of $10^3$ Hz.

In step S5, isotopes generated by the nuclear reactions are recovered.

The isotopes may be recovered directly in the target, in particular when they have been confined in the target 2 or in the envelope 4. The recovery is thus facilitated.

According to other embodiments of the invention, an isotope recovery device 10 is positioned in the vicinity of the target 2.

The calculations and the first experimental results show a great increase in the rates of reaction when the target 2 is in the plasma state, resulting in isotope production yields that are much higher than the laser methods currently proposed. Furthermore, owing to the process, the emission zone is denser and smaller, which facilitates the recovery of the isotopes.

The isotopes created may be stable isotopes, radioisotopes, or nuclear isomers, depending on the applications under consideration.

This process makes it possible in particular to produce the carbon-11 ($^{11}$C) isotope from the $^{14}$N(p,α)$^{11}$C nuclear reaction produced by a beam of protons (p) bombarding a target 2 containing nitrogen-14 ($^{14}$N) or from the $^{11}$B(p,n)$^{11}$C nuclear reaction by bombarding target containing boron $^{11}$B with protons.

Other isotopes, such as fluorine-18 ($^{18}$F), nitrogen-13 ($^{13}$N) and oxygen-15 ($^{15}$O) may be produced from the following reactions: $^{18}$O(p,n)$^{18}$F, $^{20}$Ne(d,n)$^{18}$F, $^{16}$O(p,α)$^{13}$N, $^{13}$C(p,n)$^{13}$N, $^{14}$N(d,n)$^{15}$O and $^{15}$N(p,n)$^{15}$O.

The isotopes created depend on the fuel 2 and on the particles 3 used.

Described below is an example of the implementation of the process for creating isotopes.

The first set of laser beams comprises, in this example, a laser beam that produces a laser pulse delivering 20 J in 1 ps at the wavelength of 0.53 μm.

The laser beam 1 is focused on a sheet of aluminum 6 having an initial thickness of 20 μm.

The beam of particles 3 generated is a beam of energetic protons. Protons having an exponentially decreasing energy spectrum with a maximum energy of around 12 MeV are sent to a target 2 of natural boron (20% $^{10}B$ and 80% $^{11}B$) converted into plasma just before the arrival of the beam of protons.

The conversion to the plasma state is carried out by another laser beam 5 delivering 300 J in 1.5 ns at the wavelength of 0.53 μm.

The carbon-11 ($^{11}C$) produced on a boron target by the $^{11}B(p,n)^{11}C$ reaction is measured after striking by the activation of the target 2. The $^{11}C$ produced is then measured in the target 2.

In order to evaluate the improvement in the production yield, a solid boron target is also bombarded by a beam of protons under the same conditions.

A great increase in the production of $^{11}C$ was observed when the boron target is in plasma form compared to the solid.

The process and the system described above thus enable the creation of facilities that are less expensive, more efficient and may operate on site, in particular for the production of isotopes for medicinal diagnostic and therapy purposes.

Of course, the present invention is not limited to the embodiments described above by way of example; it extends to other variants.

The invention claimed is:

1. A process for creating isotopes using laser beams, comprising steps of:

/1/ converting a target, comprising a fuel, to a plasma state, and

/2/ generating particles with a set of laser beams and bombarding the target in the plasma state with the particles wherein:

the particle generation is synchronized with the target conversion; and the bombarding produces nuclear reactions between the fuel and the particles and creates said isotopes.

2. The process as claimed in claim 1, wherein the step /2/ is repeated several times on the same target.

3. The process as claimed in claim 1, wherein the step /2/ comprises irradiating a second solid, gaseous or liquid target with the set of laser beams.

4. The process as claimed in claim 1, wherein the set of laser beams used to bombard the target is a first set of laser beams, the target being converted to the plasma state by using a second set of laser beams.

5. The process as claimed in claim 1, wherein the target comprises a hollow depression, and, at step /2/, the particles are directed into the hollow depression.

6. The process as claimed in claim 1, wherein the target is surrounded by an envelope comprising an opening, and, at step /2/, the particles bombarding the target are directed through the opening to the target.

7. The process as claimed in claim 1, wherein the nuclear reactions include nuclear chain reactions.

8. A process for creating stable isotopes, radioisotopes, or nuclear isomers using laser beams, comprising steps of:

/1/ converting a target, comprising a fuel, to a plasma state, and

/2/ generating particles with a set of laser beams and bombarding the target in the plasma state with the particles, wherein:

the particle generation is synchronized with the target conversion; and the bombarding produces nuclear reactions between the fuel and the particles and creates said stable isotopes, radioisotopes, or nuclear isomers.

* * * * *